US006736886B2

(12) United States Patent
Suda et al.

(10) Patent No.: US 6,736,886 B2
(45) Date of Patent: May 18, 2004

(54) ELECTROLESS GOLD PLATING BATH AND METHOD

(75) Inventors: Kazuyuki Suda, Saitama (JP); Yasuo Ohta, Tokyo (JP); Yasushi Takizawa, Saitama (JP)

(73) Assignee: Shipley Company, L.L.C., Marlborough, MA (US)

( * ) Notice: Subject to any disclaimer, the term of this patent is extended or adjusted under 35 U.S.C. 154(b) by 0 days.

(21) Appl. No.: 10/189,130

(22) Filed: Jul. 2, 2002

(65) Prior Publication Data

US 2003/0096064 A1 May 22, 2003

(30) Foreign Application Priority Data

Jul. 2, 2001 (JP) ..... 2001-201333

(51) Int. Cl.[7] ..... C23C 18/54; B05D 1/18
(52) U.S. Cl. ..... 106/1.23; 106/1.26; 427/437
(58) Field of Search ..... 106/1.23, 1.26; 427/437

(56) References Cited

U.S. PATENT DOCUMENTS 4,005,229 A * 1/1977 Miller et al. ..... 427/304
5,232,744 A * 8/1993 Nakamura et al. ..... 427/437
5,292,361 A * 3/1994 Otsuka et al. ..... 106/1.28
5,364,460 A * 11/1994 Morimoto et al. ..... 106/1.23
2002/0027081 A1 * 3/2002 Nagai et al. ..... 205/157
2002/0150692 A1 * 10/2002 Soutar et al. ..... 427/436
2002/0152925 A1 * 10/2002 Soutar et al. ..... 106/1.22

* cited by examiner

*Primary Examiner*—Helene Klemanski
(74) *Attorney, Agent, or Firm*—S. Matthew Cairns

(57) ABSTRACT

Electroless gold plating baths and plating methods using these baths are provided. The electroless gold plating bath includes i) water-soluble gold compound, ii) complexing agent that stabilizes gold ions in the plating bath, but does not cause substantial dissolution of nickel, cobalt or palladium in the plating bath, and iii) a polyethyleneimine compound. When a material to be plated is subjected to such a gold plating bath, corrosion of the base metal under the surface of the material to be plated is reduced by controlling the substitution reaction rate immediately after initiation of the reaction, and adhesion between the base metal and deposited gold coating is increased.

15 Claims, 1 Drawing Sheet

ELECTROLESS GOLD PLATING BATH AND METHOD

BACKGROUND OF THE INVENTION

The present invention relates to an electroless gold plating bath and electroless gold plating method used when gold plating coating is to be formed on parts used in the electronic industry, such as a printed wiring board or indium-tin-oxide ("ITO") substrate. In particular, the present invention relates to an electroless gold plating bath and method whereby base metal etching or erosion arising when gold is deposited on the material to be plated is extremely slight, so that a gold film with good adhesion, and good soldering strength is obtained.

Conventionally, gold plating has been utilized on the surfaces of electronic parts such as printed circuit boards, ceramic integrated circuit ("IC") packages, ITO substrates and IC cards in order to improve chemical resistance, oxidation resistance and physical properties such as metal conductivity, soldering properties, thermo-compression bonding properties and other connection properties. With most of these parts in the electronics industry, it is necessary to carry out gold plating in electrically isolated regions, and so the use of electrolytic gold plating is inappropriate. Electroless gold plating must be performed.

Conventional technologies that are widely known are the use of autocatalytic electroless gold plating baths whereby gold is deposited due to the action of a reducing agent having catalytic activity with respect to gold, and substitution (displacement) plating baths whereby gold is deposited along with dissolution of base metal such as nickel. These two technologies are widely used at present, and represent typical electroless gold plating baths.

With substitution gold plating, gold is deposited by replacement of the base metal, and so dissolution of base metal (etching or erosion) occurs along with deposition of the gold. With conventional substitution gold plating baths, the substitution reaction rate is not controlled, and so the substitution reaction rate is particularly rapid immediately after initiation of the reaction. A large number of defects are formed in substitution gold films due to this rapid rate immediately after initiation of the reaction, and thus these defect regions connect and accumulate, so that the base metal present under the gold film is excessively etched or corroded in the depthwise or transverse direction. When this type of substitution gold plating bath is used for gold plating, sites where the structure of the crystal grain boundaries or other structures of the base metal are weak are preferentially dissolved (etched or eroded).

It is thought that etching or erosion in the form of deep crevices thus occurs along grain boundaries in base metals after formation of gold films when a conventional substitution gold plating bath is used.

For example, when a substitution gold deposit with at thickness of 0.05–0.1 $\mu$m (micron) has been formed on an electrolessly plated nickel film at a thickness of 5 $\mu$m under common electroless nickel-gold plating specifications using known electroless nickel plating and substitution gold plating baths, the cross-section of the coating is found, by use of a scanning electron microscope, to have grooves formed under the gold film due to progressive deepening of erosion in grain boundary regions of the deposited grains. This erosion results from selective strong attack on the grain boundary regions of the deposited particles of the electroless nickel film by the gold plating solution. Although the film thickness of the deposited gold is thin, at 0.1 $\mu$m or less, the erosion depth is as much as 3–5 $\mu$m. As a result, the electroless nickel film that is formed by this type of substitution gold plating is rendered brittle, and has inferior adhesion to the gold film. In particular, the material will not withstand soldering, and thus has poor practical utility.

On the other hand, when autocatalytic electroless gold plating baths are used, immediately after immersion of the material to be plated in the plating bath, gold is deposited due to the substitution reaction occurring between the base metal and gold, and subsequently, the action of the reducing agent is initiated with the deposited gold as catalyst. Due to this two-stage reaction whereby gold is deposited, it is not possible to completely prevent etching or erosion of the base metal by the gold plating bath.

Plated films of this type have insufficient adhesion and tend to peel during durability testing. Sufficient solder strength cannot be ensured when soldering is carried out, and thus the materials tend to have poor soldering properties in solder strength tests due to exposure of the base metal.

In addition, microprocessor packages have continued to proliferate in recent years, and with ball-grid array semiconductor packages that are manufactured using printed wiring board technologies, it is necessary to perform gold plating with the objective of improving solder adhesion properties on electrically isolated patterns. However, conventional electroless gold plating technologies have serious problems in terms of the generation of defective products due to insufficient solder adhesion strength. For this reason, gold plating is currently carried out by electrolytic plating methods when improved solder adhesion properties are desired.

SUMMARY OF THE INVENTION

The present invention has the objective of offering an electroless gold plating bath whereby a plated gold layer with improved adhesion with respect to base metal can be formed without erosion of the base metal.

In addition, the present invention has the objective of offering an electroless gold plating method whereby a plated gold layer with improved adhesion with respect to base metal can be formed.

The inventors of the present invention et al., carried out painstaking investigations with the objective of attaining the above objectives, and arrived at the present invention upon discovering that the above objectives can be attained by means of using an electroless gold plating bath that contains a combination of specific components.

Specifically, the present invention concerns an electroless gold plating bath for depositing a gold film on a material to be plated having metal at its surface, where said electroless gold plating bath comprises, (i) a water-soluble gold compound, (ii) a complexing agent that stabilizes metal ions in the plating bath, but does not allow substantial dissolution of nickel, cobalt or palladium in the plating bath, and (iii) a polyethyleneimine compound. Also provided by the present invention is an electroless gold plating method that employs the aforementioned electroless gold plating bath. In this method, a metal on the surface of a material to be plated with gold is contacted with the above described plating bath, for a period of time sufficient to deposit a gold layer in a desired thickness. Specifically, the present invention is an electroless gold plating bath for producing electroless gold plating on a material to be plated having metal at its surface.

DETAILED DESCRIPTION OF THE INVENTION

Figure 1:
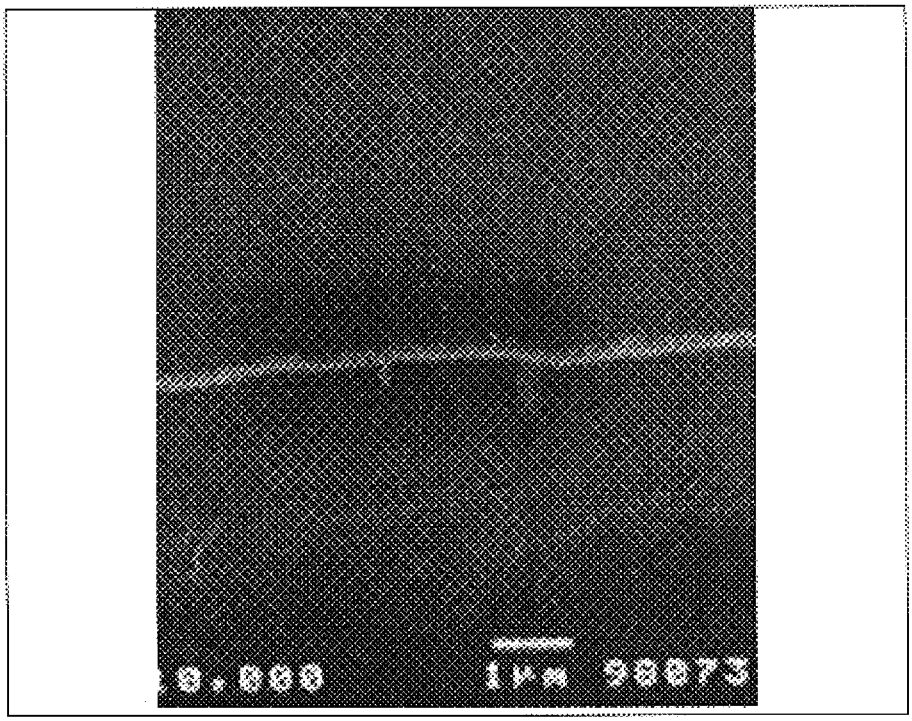
FIG. 1 is an electron micrograph showing a cross section of a composite material obtained by treating a material to be plated with an electroless gold plating bath of the present invention containing polyethyleneimine.

The water-soluble gold compound used in the present invention can be any compound that is water soluble and can supply gold ions to the plating bath. Various compounds that have been used in gold plating in the past may be used. Examples of water-soluble gold compounds include, but are not restricted to, sodium dicyanoaurate (I), ammonium dicyanoaurate (I) and other dicyanoauric acid (I) salts; potassium tetracyanoaurate (III), sodium tetracyanoaurate (III), ammonium tetracyanoaurate (III) and other tetracyanoauric acid (III) salts; gold (I) cyanide, gold (III) cyanide; dichloroauric acid (I) salts; tetrachloroauric acid (III), sodium tetrachloroaurate (III) and other tetrachloroauric acid (III) compounds; ammonium gold sulfite, potassium gold sulfite, sodium gold sulfite and other sulfurous acid gold salts; gold oxide, gold hydroxide and other alkali metal salts thereof. Preferred water-soluble gold compounds are potassium dicyanoaurate (I), potassium tetracyanoaurate (III), sodium tetrachloroaurate (III), gold ammonium sulfite, gold potassium sulfite and gold sodium sulfite. The water-soluble gold compounds may used individually, or two or more types may be mixed.

The electroless gold plating bath of the present invention should contain these water-soluble gold compounds as gold ions in the amount of, for example, 0.1–10 g/L, with 1–5 g/L being preferred. If the concentration is less than 0.1 g/L, then the plating reaction will be slow or will not readily occur. If the concentration of gold ions exceeds 10 g/L, the plating bath will work but a dramatic corresponding increase in effects is not observed, so the use of gold ions in such amounts is thus not economical.

The complexing agent used in the present invention maintains the gold ions in stable form in the plating bath, but also does not substantially dissolve nickel, cobalt or palladium in the plating bath. Examples of this type of complexing agent include, but are not restricted to, organic phosphonic acids or salts thereof that have more than one phosphonic acid group or salt thereof. Groups represented by the following structure are preferred examples of phosphonic acid groups or salts thereof.

$$-PO_3MM'$$

In the above formula, M and M' are the same or different, and are selected from hydrogen, sodium, potassium or ammonium ($NH_4$). The number of phosphonic acid groups or salts thereof in a single molecule should be 2 or more, with 2–5 being preferred.

The compounds having the structures shown in (1)–(3) below are preferred examples of complexing agents used in the present invention.

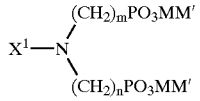

(1)

In formula (1), $X^1$ is a $C_{1-5}$ alkyl group substituted with groups selected from a carboxyl group, carboxyl group salt (—COOM), phosphonic acid group and phosphonic acid group salt (—$PO_3MM'$); hydrogen atom; $C_{1-5}$ alkyl group; aryl group; arylalkyl group; amino group and hydroxyl group, M and M' are the same as defined above; and m and n are 0–5. The $C_{1-5}$ alkyl group referred to herein can have branched chains or linear chains, and examples of this type of alkyl group include methyl, ethyl, propyl, isopropyl, butyl, isobutyl, sec-butyl, tert-butyl and pentyl. Examples of aryl groups include phenyl and naphthyl. Examples of amino groups are amino groups wherein a hydrogen atom and/or alkyl group of the type indicated above is bonded to the nitrogen atom.

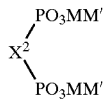

(2)

In formula (2), $X^2$ is —$CH_2$—, —CH(OH)—, —C($CH_3$)(OH)—, —CH(COOM)— or —($CH_3$)(COOM)—; and M and M' are as defined above.

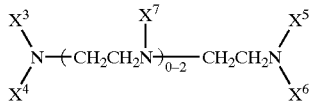

(3)

In formula (3), $X^3$-$X^7$ are independently selected from the groups as defined for $X^1$ above; and M and M' are the same as above, provided that at least two of $X^3$-$X^7$ are phosphonic acid groups or salts thereof (—$PO_3MM'$). Preferred specific examples of the aforementioned complexing agent include aminotrimethylenephosphonic acid, 1-hydroxyethylidene-1, 1-diphosphonic acid, ethylidenediamine tetramethylenephosphonic acid, diethylenetriaminopentamethylenephosphonic acid, and sodium salts, potassium salts and ammonium salts thereof.

The complexing agents used in the present invention can be used individually, or in mixtures of two or more types.

The complexing agent used in the present invention should be used, for example, in the range of 0.005–0.5 mol/L, with a range of 0.02–0.2 mol/L being preferred. In particular, the complexing agent should be contained in an equivalent or greater molar amount with respect to the gold ions contained in the plating bath. If the complexing agent concentration is less than 0.005 mol/L, or is present in less than an equimolar the amount compared to the gold ions in the plating bath, then the complexing agent will not be able to maintain the gold ions in stable form, and gold precipitation will tend to occur in the plating bath. While the amount of complexing agent may exceed 0.5 mol/L, such large amounts are not necessary from an economic standpoint because sufficient corresponding improvement in effect cannot be expected.

Polyethyleneimine is also contained in the present electroless gold plating bath. Although the function of the polyethyleneimine is not completely understood, it is believed that the polyethyleneimine acts as a gold precipitation inhibitor in the present electroless gold plating baths by adsorbing to the metal surface to be plated thus slowing the substitution reaction rate.

While not intending to be bound by theory, the addition of a polyethyleneimine compound to the electroless gold plating bath can slow said substitution reaction rate immediately after initiation of the substitution reaction between gold ions in the plating bath and the metal of the material to be plated. As a result, the defect (or pit) regions of the substituted gold coating formed on the base metal are kept extremely small, and are distributed uniformly. Consequently, excessive etching or erosion of the base metal is kept to a minimum, and in particular, expansion of etching or erosion of the base metal in the depthwise direction or lateral direction in the surface of the material to be plated can be prevented, making it possible to form a gold plated film with excellent adhesion to the base metal film.

The polyethyleneimine used in the present invention has repeating units consisting only of the following structure:

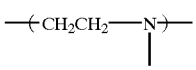

(4)

Suitable polyethyleneimine compounds contain 4 or more, and preferably 6 or more, of the aforementioned repeating units. The compound can also be a compound in which nitrogen atoms are present as primary, secondary or tertiary amines, and in which terminal hydroxyl groups are present.

Specifically, the polyhydroxylamine is represented by formula (5):

$$R''HN—(CH_2—CH_2—NR)_a—R' \quad (5)$$

wherein R is a group comprising one or more of the aforementioned repeating units of formula (4); R' and R" are each a hydrogen atom or hydroxyl group, with a hydrogen atom being preferred, and a is an integer of 4 or greater, with 6 or greater being preferred.

The polyethyleneimine of the present invention may be a molecule that exhibits a linear structure in which the aforementioned repeating units of formula (4) are linearly linked, or a molecule in which such repeating units are linked so as to manifest a branched structure. Examples of polyethyleneimine compounds that exhibit linear or branched structures are presented in formulas (6) and (7).

$$R''HN—(CH_2—CH_2—NH)_b—R' \quad (6)$$

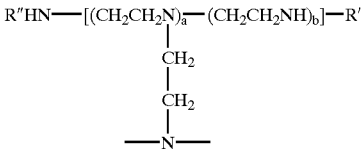

(7)

wherein R' and R" are as described above, and a and b are integers of 4 or greater, and preferably 6 or greater.

In formula (7), linkage groups of the nitrogen atom are not shown, but the linkage groups can be freely selected from repeating units of formula (4), hydrogen atoms and hydroxyl groups. In formula (7), repeating units having branches and repeating units not having branches can be linked randomly as desired.

When the polyethyleneimine compounds have a branched structure, branching chains (represented by R in formula (5)) having any length and branching form are bonded to the nitrogen atom in any number of repeating units and at any position from the termini of the side chains in the polyethyleneimine to which multiple units of the aforementioned repeating unit (4) are linked. With regard to bonding format in the branched regions, the bondable carbon atoms in the aforementioned repeating units (4) (carbon atoms that are not bonded to nitrogen atoms in the above repeating units) are bonded to the nitrogen atoms of other repeating units (nitrogen atoms to which R is bonded in formula (5)). Said branching chains in the polyethyleneimine (represented by R in formula (5)) also may be chains that have the aforementioned repeating units of formula (4), or may be chains formed by the linkage of any number of repeating units, where the linkage mode can manifest a branching or linear structure.

In formula (5), R' and R" are each independently hydrogen atoms or hydroxyl groups, meaning that the terminals of the polyethyleneimine will be amino groups or hydroxyamino groups. In addition, the aforementioned branched chains in the polyethyleneimine of the present invention may be amino groups or hydroxyamino groups. It is preferable for the terminals of the polyethyleneimine to be amino groups.

The appropriate molecular weight of the polyethyleneimine compounds used in the present invention is, for example, 300–100,000, with 1000–20,000 being preferred. If the molecular weight is less than 300, the gold plating bath will selectively attack the crystal grain boundary regions of the base metal present below defect regions (pits) present in the substitution gold plating film. Consequently, etching or erosion will occur over a broad range in the depthwise or transverse direction. If the molecular weight is 100,000, on the other hand, solubility will decrease.

The polyethyleneimine compounds used in the present invention can be used individually, or two or more compounds having different molecular weights and branched structures may be mixed. The electroless gold plating bath of the present invention contains 0.01–100 g/L of polyethyleneimine compound, with 0.1–50 g/L being preferred.

If the amount of polyethyleneimine is less than 0.01 g/L, the gold plating bath will selectively attack the crystal grain boundary regions of the base metal present below defect regions (pits) present in the substitution gold plating film. Consequently, etching or erosion will occur over a broad range in the depthwise or transverse direction. While the amount of polyethyleneimine compound may exceed 100 g/L, such large amounts are not necessary from an economical standpoint because sufficient corresponding dramatic improvements in effects are not obtained.

The electroless gold plating bath of the present invention can optionally contain, as necessary, pH stabilizers, luster agents, wetting agents, reducing agents and other additives.

Examples of pH stabilizers include phosphates, phosphites, borates, carboxylates and other salts. In addition, examples of pH stabilizers for the gold plating bath of the present invention that may be used include sodium hydroxide, potassium hydroxide, ammonium hydroxide, sulfuric acid, sulfurous acid, hydrochloric acid, phosphoric acid, sulfamic acid, organic sulfonic acids, phosphonic acids and carboxylic acids.

Luster agents can be contained in the electroless gold plating bath of the present invention with the objective of additionally reducing the grain size of the plated gold film and/or increasing the luster of the plated gold film. The luster agent can be any metal luster agent that has been used in the past for gold plating, without particular restrictions.

Examples include thallium, arsenic, lead, copper and antimony. The amount of luster agent contained in the present electroless gold plating bath is selected appropriately in accordance with the plating bath composition, the type of metal on the material to be plated, and the type of luster agent that is used. However, the amount is generally a concentration of 0.01–200 mg/L, with 0.1–100 mg/L being preferred.

Wetting agents may also be used in the present electroless gold plating bath with the objective of improving wetting of the metal that is the material to be plated. Various types of materials may be used as wetting agent without particular restrictions, provided that they are substances that have been used in the past for gold plating. Examples of wetting agents include, but are not restricted to, polyoxyalkylene alkyl ether, polyoxyalkylene alkylphenyl ether, polyoxyethylene polyoxypropylene glycol, polyalkylene glycol fatty acid esters, polyalkylene sorbitan fatty acid esters, fatty acid alkanol amides and other nonionic surfactants, fatty acid carboxylates, alkanesulfonates, alkylbenzene sulfonates, alkylnaphthalene sulfonates, alkyl sulfates, polyoxyalkylene alkyl ether sulfates, alkyl phosphates, polyoxyalkylene alkyl ether phosphates, polyoxyalkylene alkyl phenyl ether phosphates and other anionic surfactants, alkylamine salts, quaternary ammonium salts and other cationic surfactants, alkylbetaine, alkylimidazoline derivatives, alkyldiethylenetriamine acetic acid and other amphoteric surfactants. The amount of wetting agent contained in the electroless gold plating bath of the present invention is determined appropriately depending on the composition of the plating bath and the type of metal that constitutes the material to be plated. The concentration is generally $1\times10^{-8}$ mol/L to $1\times10^{-2}$ mol/L, with $1\times10^{-6}$ mol/L to $1\times10^{-4}$ mol/L being preferred.

Reducing agents may also be used in the plating bath of the present invention. Ordinarily, various reducing agents can be used without particular restrictions, provided that they are reducing agents that are commonly used in electroless gold plating. Examples of reducing agents include, but are not restricted to, dimethylaminoborane, diethylaminoborane and other alkylaminoboranes, sodium borohydride, lithium borohydride and other borohydride compounds. These reducing agents may be used individually or in mixtures of two or more. The amount of reducing agent contained in the electroless gold plating bath of the present invention is to be selected appropriately in accordance with the plating bath composition, the type of metal that constitutes the material to be plated and the desired gold film thickness, among other factors. The concentration is generally 0.001–1 mol/L, with 0.01–0.5 mol/L being preferred.

The aforementioned electroless gold plating bath of the present invention can be used in electroless metal plating methods in which the material to be plated having metal at its surface is immersed in or contacted with said electroless gold plating bath, thereby bringing about deposition of gold film on the material to be plated.

In this specification, the term "electroless gold plating" refers to methods wherein gold plating is carried out without applying external electrical energy to the aqueous solution, and refers to substitution gold plating and autocatalytic electroless gold plating (also referred to as "autocatalytic chemical gold plating").

When the electroless gold plating bath of the present invention is to be used as an autocatalytic electroless gold plating bath, it contains reducing agent. In the first-stage reaction of the autocatalytic electroless gold plating method of this system, gold ions in the plating bath and metal present at the surface of the material to be plated undergo a substitution reaction, thus forming a substitution plated gold film. At this time, it is possible for a plated gold film with excellent adhesion with respect to the base metal film to be formed, as with the aforementioned substitution gold plating methods. In addition, dissolution (etching or erosion) of base metal by the electroless gold plating bath is prevented, which has the effect of extending the life of the autocatalytic electroless gold plating bath.

The electroless gold plating method of the present invention can employ the substitution gold plating method as a pretreatment for autocatalytic electroless gold plating. By completely coating the entire surface of the base metal using the electroless gold plating method of the present invention, and then carrying out autocatalytic electroless gold plating, it is possible to initiate the autocatalytic reaction without etching or erosion of the base metal. As a result, a gold plating film with good binding can be obtained. By using the electroless gold plating method of the present invention as a pretreatment for autocatalytic electroless gold plating, contamination due to dissolution of base metal in the autocatalytic electroless gold plating bath can be prevented, which has the effect of extending the life of the electroless gold plating bath.

A material to be plated having any metal at its surface can be used with the electroless gold plating method of the present invention. The term "metal" used in the present invention is defined as a material that contains metal composed of a single metal element, or a material that contains an alloy composed of multiple metal elements. From the standpoint of the substitution reaction, it is preferable for the metal present at the surface of the material to be coated to be a metal composed of a metal element that is less precious than gold. In addition, it is more preferable for the metal used in the present invention to be nickel, cobalt or palladium metal, or an alloy containing at least one element selected from nickel, cobalt or palladium. In terms of the alloy having this configuration, any alloy that contains other desired metal elements can be used, provided that it does not impede attainment of the objectives of the present invention, and provided that at least one of nickel, cobalt or palladium is present.

The metal of the material to be plated serves as the base metal in the electroless gold plating method of the present invention. By means of the substitution reaction in the present substitution gold plating method, or by means of the substitution reaction and the subsequent reduction reaction in the autocatalytic electroless gold plating method, a gold film is deposited on the base metal.

The material to be plated in the present invention can be in any desired form, for example, a flat or bent plate, rod or sphere, but examples are not restricted to these. In addition, the material to be plated can be a material that has been subjected to processing involving the formation of fine grooves or holes, such as processes used with printed wiring board substrates, IC card substrates, ITO substrates, ceramic IC package substrates or substrates for other parts used in the electronics industry.

The aforementioned base metal need not completely coat the material to be plated, provided it is present on part of the surface of the material to be plated. Alternatively, the entire surface of the material to be plated can be covered with the aforementioned base metal. The material to be plated of the present invention may be formed from the same metal as the base metal formed over its entire surface, or a configuration is also acceptable wherein a non-metallic material such as resin or ceramic serves as a substrate, and the aforementioned base metal is coated thereupon.

The aforementioned base metal can be formed by any method including mechanical processing such as rolling, electroplating methods, electroless plating methods or gas phase plating methods. The thickness has no particular restrictions, but 0.1 μm, for example, is sufficient.

When performing electroless gold plating of the present invention, the plating temperature (bath temperature) is generally 50–95° C., with 60–90° C. being preferred. The plating time is 1–60 min, with 10–30 min being preferred. If the plating temperature is less than 50° C., the plating film deposition rate will be slow, which may be disadvantageous from a productivity and economic standpoint. Temperatures exceeding 95° C. may be used, but there is the danger that the components of the plating bath will decompose.

Prior to treating the material to be plated with the electroless gold plating bath of the present invention, the material may be subjected to a pre-dip process with the objective of preventing dilution of the constitutive components of the plating bath. The pre-dip solution referred to herein denotes an aqueous solution that contains the aforementioned complexing agent and/or polyethyleneimine compound, along with other additives as desired, but does not contain gold ions.

When carrying out electroless gold plating of the present invention, stirring can be carried out, and replacement filtration or circulation filtration can also be carried out. It is particularly desirable to subject the plating bath to circulation filtration with a filtration device. By such means, the temperature of the plating bath can be made uniform, and waste, precipitate and other substances in the plating bath can be eliminated. In addition, air can also be introduced into the plating bath, and by this means, sediment generated along with production of gold particles or gold colloid particles can be more effectively prevented in the plating bath. Air introduction can be carried out by using an air stirrer when stirring the plating bath, or by bubbling air separate from the stirring operation.

According to the electroless gold plating method of the present invention, a gold coating with excellent physical characteristics such as electrical conductivity, solderability and thermo-compression bonding properties, as well as excellent oxidation resistance and chemical resistance, can be formed over electrically isolated regions of a material to be plated. Said method is thus appropriate for use in the manufacture of composite materials such as printed wiring boards, ceramic IC packages, ITO substrates, IC cards and other electronic parts. In particular, with composite materials manufactured by means of the electroless gold plating method of the present invention, adhesion between the gold coating and base metal can be improved, and soldering strength can be improved when solder is applied to said gold coating. Thus, the electroless gold plating method of the present invention is particularly effective in the manufacture of ball grid array semiconductor packages that are manufactured using printed wiring board technologies. These packages are being increasingly used as microprocessor packages, and require the formation of gold films having improved soldering properties.

In addition, regarding composite materials formed by the electroless gold plating method of the present invention, electroless metal plating or an electroless metal plating treatment can also be carried out in order to form a metal coating on the gold film or any other region of said composite material.

The present invention is described in additional detail by means of working examples and comparative examples, but the scope of the present invention is not at all limited by these working examples and comparative examples.

EXAMPLES

The electroless gold plating baths having the compositions shown in Examples 1–3 and Comparative Examples 1–3 were produced, and were subjected to the electroless gold plating tests described below.

Example 1

Potassium gold cyanide: 2 g/L (as gold ions)
Ethylenediaminetetramethylenephosphonic acid: 0.15 mol/L
Polyethyleneimine (molecular weight 2000): 5 g/L
pH: 7.0

Example 2

Potassium gold cyanide: 2 g/L (as gold ions)
Ethylenediaminetetramethylenephosphonic acid: 0.15 mol/L
Polyethyleneimine (molecular weight 20,000): 5 g/L
pH: 7.0

Example 3

Potassium gold cyanide: 2 g/L (as gold ions)
1-Hydroxyethylidene-1,1-diphosphonic acid: 0.15 mol/L
Polyethyleneimine (molecular weight 2000): 5 g/L
pH: 7.0

Comparative Example 1

(plating bath produced as in working examples, but without polyethyleneimine)
Potassium gold cyanide: 2 g/L (as gold ions)
Ethylenediaminetetramethylenephosphonic acid: 0.15 mol/L
pH: 7.0

Comparative Example 2

(conventional substitution gold plating bath)
Potassium gold cyanide: 2 g/L (as gold ions)
Disodium ethylenediaminetetraacetic acid: 0.32 mol/L
Citric acid: 0.38 mol/L
Phosphoric acid: 1.54 mol/L
Potassium hydroxide: 1.89 mol/L
pH: 5.8

Comparative Example 3

(conventional autocatalytic electroless plating bath)
Potassium gold cyanide: 1 g/L (as gold ions)
Potassium cyanide (0.17 mol/L)
Disodium ethylenediaminetetraacetic acid: 0.013 mol/L
Potassium hydroxide: 0.2 mol/L
Ethanolamine: 0.8 mol/L
Tetrahydroboric acid: 0.2 mol/L
pH: 10.0

The method for measuring the substitution reaction rates (substitution-plated gold deposition rate) for the electroless gold plating baths is described below. The sample plates were material produced by using a conventional method to deposit nickel at a thickness of about 5 μm onto a 4×4 cm copper plate by electroless nickel plating. Gold plating was then carried out at a bath temperature of 90° C. using the electroless gold plating baths of Examples 1–3 and Comparative Examples 1–3. Five sample plates were immersed in a single plating bath, and the sample plates were removed one at a time every 10 min. The film thickness of the gold deposit at each time point (10 min to 50 min) was measured using a fluorescent x-ray microfilm thickness gage. The substitution reaction rate (substitution-plated gold deposition rate) was then calculated for each 10 min period based on the plating bath immersion time and film thickness. The results are shown in Table 1.

TABLE 1

Substitution plating deposition rate measurement results

| Bath Type | Top Value: Deposition Film Thickness (μm)/Bottom Value: Deposition Rate (μm/min) | | | | |
|---|---|---|---|---|---|
| | 10 min | 20 min | 30 min | 40 min | 50 min |
| Example 1 | 0.013 | 0.048 | 0.055 | 0.064 | 0.076 |
| | 0.0013 | 0.0024 | 0.0018 | 0.0016 | 0.0015 |
| Example 2 | 0.016 | 0.058 | 0.067 | 0.079 | 0.094 |
| | 0.0016 | 0.0029 | 0.0023 | 0.0020 | 0.0019 |
| Example 3 | 0.011 | 0.044 | 0.053 | 0.066 | 0.083 |
| | 0.0011 | 0.0033 | 0.0031 | 0.0021 | 0.0017 |
| Comparative | 0.083 | 0.126 | 0.178 | 0.218 | 0.250 |
| Example 1 | 0.0083 | 0.0043 | 0.0052 | 0.0040 | 0.0032 |
| Comparative | 0.098 | 0.156 | 0.200 | 0.234 | 0.259 |
| Example 2 | 0.0098 | 0.0058 | 0.0044 | 0.0034 | 0.0025 |
| Comparative | 0.332 | 0.673 | 0.985 | 1.286 | 1.573 |
| Example 3 | 0.0332 | 0.0341 | 0.0312 | 0.0301 | 0.0287 |

As shown in Table 1, when the plating baths of Examples 1–3 containing polyethyleneimine were used, the substitution plating deposition rate was the smallest in the 10 min immediately following immersion of the sample plate in the plating bath. It was clear that the substitution reaction rate was slowed.

On the other hand, in Comparative Examples 1–3, the plating deposition rate was fastest in the 10 min immediately following immersion of sample plates in the plating bath. It was clear that the substitution reaction progressed rapidly immediately after immersion of the sample plates.

The method for evaluating binding of the gold-plated films is described below. A well-known method was used in order to perform electroless nickel plating at a thickness of about 5 μm on a printed wiring board having circular plated regions with diameters of 0.5 mm. After then carrying out gold plating at a thickness of about 0.05 μm at a bath temperature of 90° C. using the electroless gold plating baths of the working examples and comparative examples, soldering was carried out by vapor phase soldering using 60% tin, 40% lead solder balls having a diameter of 0.76 mm. Transverse force was then applied to the solder balls that had been soldered, and the balls were broken. At this time, it was determined by microscopy whether separation of the plated coating had occurred. The number of soldered regions where separation occurred was determined. The results are shown in Table 2.

TABLE 2

Result of gold plating coating adhesion testing

| Bath Type | Number of Plating Separations |
|---|---|
| Example 1 | 0/50 |
| Example 2 | 0/50 |
| Example 3 | 0/50 |
| Comparative Example 1 | 32/50 |
| Comparative Example 2 | 40/50 |
| Comparative Example 3 | 30/50 |

As shown in Table 2, with the gold plated coatings obtained from the plating baths of Comparative Examples 1–3 in which the substitution reaction rate was not reduced, separation of the plated coating occurred in over half of the tests. Defects were confirmed by exposure of the base metal.

In contrast, no defects were found with the gold plated coatings obtained from the plating baths of Examples 1–3 that contained polyethyleneimine.

As is clear from these results, the electroless gold plating baths of the present invention allowed the formation of electroless gold plated coatings with excellent adhesion. On the other hand, it was not possible to obtain electroless gold plated coatings with good adhesion using the plating baths of the comparative examples produced in accordance with conventional technologies.

In addition, a cross section of a composite material obtained by treating the material to be plated with the plating bath of Example 1 was observed with an electron microscope. As is clear from the electron micrograph shown in FIG. 1, the gold plating layer at the surface adhere well to the base metal.

Figure 2:
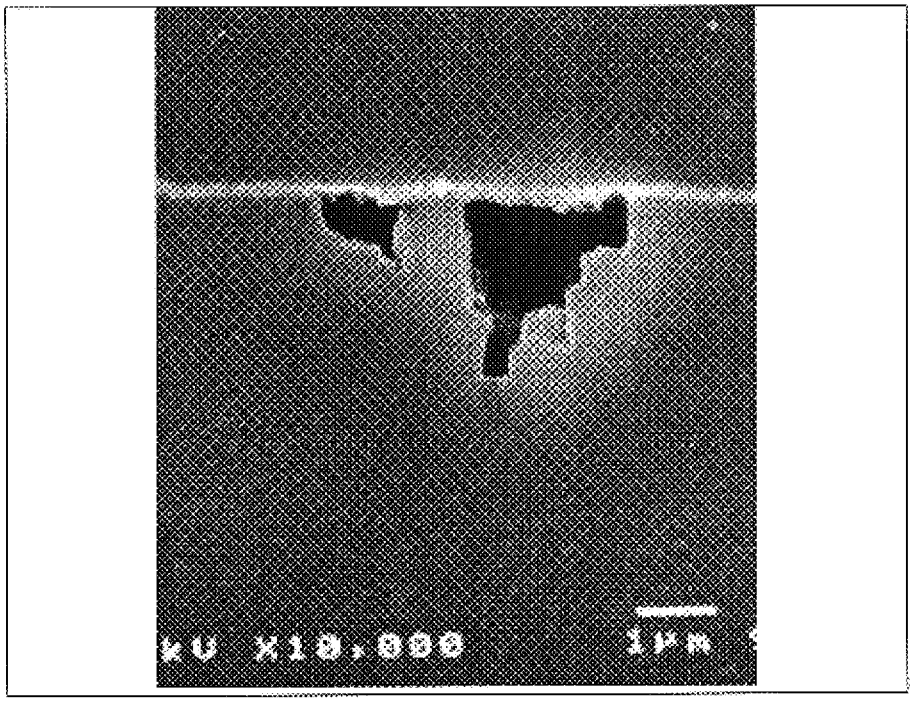
FIG. 2 is an electron micrograph showing a cross section of a composite material obtained by treating a material to be plated with a prior art electroless gold plating bath which does not contain polyethyleneimine.

Similar investigations were carried out with the plated material obtained in Comparative Example 1, but significant corrosion occurred in the depthwise direction of the base metal under the substitution gold plated layer, as shown in FIG. 2. FIG. 2 is a cross sectional electron micrograph of the composite material obtained by treating the material to be plated with the plating bath of Comparative Example 1.

As is clear from the aforementioned adhesion tests and electron micrographs, it was determined that the plated material obtained in Comparative Example 1 had inferior adhesion properties between the substitution gold-plated layer and base metal due to corrosion of the base metal. On the other hand, it was concluded that suppression of base metal corrosion with the electroless gold plating bath of the present invention in Example 1 brought about improved adhesion between the substituted gold-plated layer and the base metal.

The electroless gold plating bath of the present invention has a specific composition that includes polyethyleneimine. When using this plating bath to carry out gold plating treatment on a material to be treated, the substitution reaction rate immediately after initiation of the reaction is suppressed. By this means, corrosion of the base metal on the surface of the material to be plated is reduced, and adhesion between the base metal and deposited gold coating can thus be improved. In addition, when autocatalytic electroless gold plating is carried out using the present electroless gold plating bath, dissolution of base metal in said autocatalytic electroless gold plating bath is prevented. As a result, contamination of the autocatalytic electroless gold plating bath is prevented, allowing an increase in the life of such plating bath.

What is claimed:

1. An electroless gold plating bath comprising (i) a water-soluble gold compound, (ii) a complexing agent that stabilizes metal ions in the plating bath, but does not cause substantial dissolution of nickel, cobalt or palladium in the plating bath, and (iii) a polyethyleneimine compound.

2. The electroless gold plating bath according to claim 1, wherein the polyethyleneimine compound has a weight-average molecular weight of 300–100,000.

3. The electroless gold plating bath according to claim 1, wherein the polyethyleneimine compound is present in the plating bath at 0.01–100 g/L.

4. The electroless gold plating bath according to claim 1, wherein the complexing agent is an organic phosphonic acid or salt thereof, having more than one phosphonic acid group or salt thereof.

5. The electroless gold plating bath according to claim 1, wherein the complexing agent is present in the plating bath at 0.005–0.5 mol/L.

6. The electroless gold plating bath according to claim 1, further comprising at least one additive selected from the group consisting of pH stabilizer, luster agent, wetting agent and reducing agent.

7. A method for electrolessly depositing gold comprising contacting a metal on the surface of a material to be plated with a gold plating bath comprising (i) a water-soluble gold compound; (ii) a complexing agent that stabilizes metal ions in the plating bath but does not cause substantial dissolution of nickel, cobalt or palladium in the plating bath; and (iii) a polyethyleneimine compound.

8. The method of claim 7, wherein the metal comprises nickel, cobalt, palladium or an alloy of nickel, cobalt or palladium.

9. The method of claim 7 wherein the polyethyleneimine compound has a weight-average molecular weight of 300–100,000.

10. The method of claim 7, wherein the polyethyleneimine compound is present in the plating bath at 0.01–100 g/L.

11. The method of claim 7, wherein the complexing agent is an organic phosphonic acid or salt thereof having more than one phosphonic acid group or salt thereof.

12. The method of claim 7, wherein the complexing agent is present in the plating bath at 0.005–0.05 mol/L.

13. The method of claim 7, wherein the plating bath further comprises at least one additive selected from the group consisting of pH stabilizer, luster agent, wetting agent and reducing agent.

14. A composite material manufactured by the method of claim 7.

15. An electroless gold plating comprising (i) a water-soluble gold compound, (ii) a complexing agent comprising more than one organic phosphonic acid or salt thereof, and (iii) a polyethylenimine compound, wherein the complexing agent stabilizes metal ions in the plating bath, but does not cause substantial dissolution of nickel, cobalt or palladium in the plating bath, and wherein the organic phosphonic acid or salt thereof comprises a group of the formula —$PO_3MM'$ wherein M and M' are the same or different and are chosen from hydrogen, sodium, potassium and ammonium.

* * * * *